US008742272B2

(12) United States Patent
English et al.

(10) Patent No.: US 8,742,272 B2
(45) Date of Patent: Jun. 3, 2014

(54) ELECTRICAL CONTACTS WITH LASER DEFINED GEOMETRIES

(75) Inventors: Gerald Robert English, Glen Ellyn, IL (US); Joseph C. Boetto, Hoffman Estates, IL (US)

(73) Assignee: Laird Technologies, Inc., Earth City, MO (US)

( * ) Notice: Subject to any disclaimer, the term of this patent is extended or adjusted under 35 U.S.C. 154(b) by 0 days.

(21) Appl. No.: 13/546,712

(22) Filed: Jul. 11, 2012

(65) Prior Publication Data

US 2012/0276791 A1 Nov. 1, 2012

Related U.S. Application Data

(63) Continuation of application No. PCT/US2011/021062, filed on Jan. 13, 2011.

(60) Provisional application No. 61/294,959, filed on Jan. 14, 2010.

(51) Int. Cl.
*H01H 1/06* (2006.01)

(52) U.S. Cl.
USPC ..... 200/275

(58) Field of Classification Search
USPC ..... 200/275, 314, 5 A, 406–409, 450, 459, 200/276; 29/17.1, 20.1, 25.01–25.03, 29/592.1, 601, 603.18, 622, 829–832, 29/842–847, 868, 874, 884, 745–749, 29/755; 219/121.6, 121.61, 121.67, 219/121.73, 137.71, 138, 444.1, 121.68, 219/121.69, 121.72; 324/758.02
See application file for complete search history.

(56) References Cited

U.S. PATENT DOCUMENTS

| | | | |
|---|---|---|---|
| 4,011,360 | A | 3/1977 | Walsh |
| 4,988,306 | A | 1/1991 | Hopfer, III et al. |
| 5,068,493 | A | 11/1991 | Benn, Sr. et al. |
| 5,118,299 | A | 6/1992 | Burns et al. |
| 5,141,770 | A | 8/1992 | Benn, Sr. et al. |
| 5,556,286 | A | 9/1996 | Ikesugi et al. |

(Continued)

FOREIGN PATENT DOCUMENTS

| | | |
|---|---|---|
| CN | 1295782 | 5/2001 |
| CN | 101584088 | 11/2009 |

(Continued)

OTHER PUBLICATIONS

Gore-Shield Supersoft SMT EMI Gaskets and Grounding Pads, 2 pages.

(Continued)

*Primary Examiner* — Edwin A. Leon
*Assistant Examiner* — Anthony R. Jimenez
(74) *Attorney, Agent, or Firm* — Harness, Dickey & Pierce, PLC

(57) ABSTRACT

According to various aspects, exemplary embodiments are provided of electrical contacts, which may be used for establishing an electrical pathway between first and second electrically conductive surfaces. In an exemplary embodiment, an electrical contact may include an electrically conductive base member and at least one resilient contact member. The at least one resilient contact member may have a configuration at least partially defined by a laser cut in or into the electrically conductive base member. The at least one resilient contact member may also be formed so as to protrude outwardly from the electrically conductive base member.

22 Claims, 5 Drawing Sheets

(56) References Cited

U.S. PATENT DOCUMENTS

| | | | | |
|---|---|---|---|---|
| 5,748,449 | A | 5/1998 | Tahmassebpur | |
| 5,812,378 | A * | 9/1998 | Fjelstad et al. | 361/769 |
| 5,984,697 | A | 11/1999 | Moran et al. | |
| 6,149,443 | A | 11/2000 | Moran | |
| 6,224,392 | B1 | 5/2001 | Fasano et al. | |
| 6,551,112 | B1 | 4/2003 | Li et al. | |
| 6,663,399 | B2 | 12/2003 | Ali et al. | |
| 6,893,952 | B2 | 5/2005 | Jiang et al. | |
| 7,112,740 | B2 | 9/2006 | Van Haaster | |
| 7,129,421 | B2 | 10/2006 | Reis et al. | |
| 7,219,426 | B2 * | 5/2007 | Haga | 29/874 |
| 7,442,045 | B1 | 10/2008 | Di Stefano | |
| 7,488,181 | B2 | 2/2009 | van Haaster | |
| 7,625,218 | B2 | 12/2009 | van Haaster | |
| 7,775,808 | B2 * | 8/2010 | Okuda et al. | 439/82 |
| 7,883,340 | B2 | 2/2011 | van Haaster | |
| 2002/0037657 | A1 | 3/2002 | Hirai et al. | |
| 2003/0052755 | A1 | 3/2003 | Barnes et al. | |
| 2004/0216910 | A1 | 11/2004 | Reis et al. | |
| 2009/0032915 | A1 | 2/2009 | Cherian et al. | |
| 2009/0111290 | A1 | 4/2009 | van Haaster | |

FOREIGN PATENT DOCUMENTS

| | | |
|---|---|---|
| WO | WO 99/51074 | 10/1999 |
| WO | WO 2008/085599 | 7/2008 |
| WO | WO 2011/088164 | 7/2011 |

OTHER PUBLICATIONS http://en.wikipedia.org/wiki/Pogo_pin, printed on Aug. 5, 2009, 1 page.

International Search Report and Written Opinion dated Sep. 27, 2011 for International patent application No. PCT/US2011/021062 (published as WO 2011/088164 on Jul. 21, 2011). The instant application is a continuation of International patent application No. PCT/US2011/021062; 11 pages.

* cited by examiner

ELECTRICAL CONTACTS WITH LASER DEFINED GEOMETRIES

CROSS-REFERENCE TO RELATED APPLICATIONS

This application is a continuation of PCT International Patent Application No. PCT/US2011/021062 filed Jan. 13, 2011 (published as WO2011/088164 on Jul. 21, 2011) which, in turn, claims priority to and benefit of U.S. Provisional Patent Application No. 61/294,959 filed Jan. 14, 2010. The entire disclosures of the above-identified applications are incorporated herein by reference in their entirety.

FIELD

The present disclosure relates to electrical contacts with geometries/configurations at least partially defined by laser cuts or other suitable processes, and methods for making electrical contacts.

BACKGROUND

This section provides background information related to the present disclosure which is not necessarily prior art.

Printed circuit boards usually include electrical components that radiate electromagnetic waves, which may cause noise or unwanted signals to appear in electrical devices existing within certain proximity of the radiating electrical components. Accordingly, it is not uncommon to provide grounding for circuitry that emits or is susceptible to electromagnetic radiation, to thereby allow offending electrical charges and fields to be dissipated without disrupting operation.

To accomplish this grounding, some printed circuit boards are provided with pem-type standoffs. Additional grounding solutions may include customized contacts that are designed specifically for the particular application. In such applications, the custom design usually depends, for example, on the exact printed circuit board layout and configuration. Other grounding solutions require through holes on multi-layered boards, which may entail re-routing hundreds of ground traces. Plus, the need for additional grounding contacts frequently arises later during the printed circuit board (PCB) layout. Other example grounding solutions include metal spring-finger contacts or hard fasteners using nuts.

SUMMARY

This section provides a general summary of the disclosure, and is not a comprehensive disclosure of its full scope or all of its features.

According to various aspects, exemplary embodiments of electrical contacts, which may be used for provided for establishing an electrical pathway between multiple electrically conductive surfaces. In an example embodiment, an electrical contact may include an electrically conductive base member and at least one resilient contact member. The at least one resilient contact member may have a configuration at least partially defined by a laser cut in or into the electrically conductive base member. The at least one resilient contact member may also be formed so as to protrude outwardly from the electrically conductive base member.

As another example, an electrical contact may include an electrically conductive base member and at least one resilient contact member integrally formed from the electrically conductive base member. The at least one resilient contact member may have a generally spiral shape or multiple cantilevers. The at least one resilient contact member may protrude outwardly from the electrically conductive base member.

According to additional aspects, exemplary embodiments of methods are disclosed for making electrical contacts that may be used for establishing an electrical pathway between multiple electrically conductive surfaces. In an example embodiment, a method generally includes laser cutting a portion of an electrically conductive base member so as to form at least a portion of least one resilient contact member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
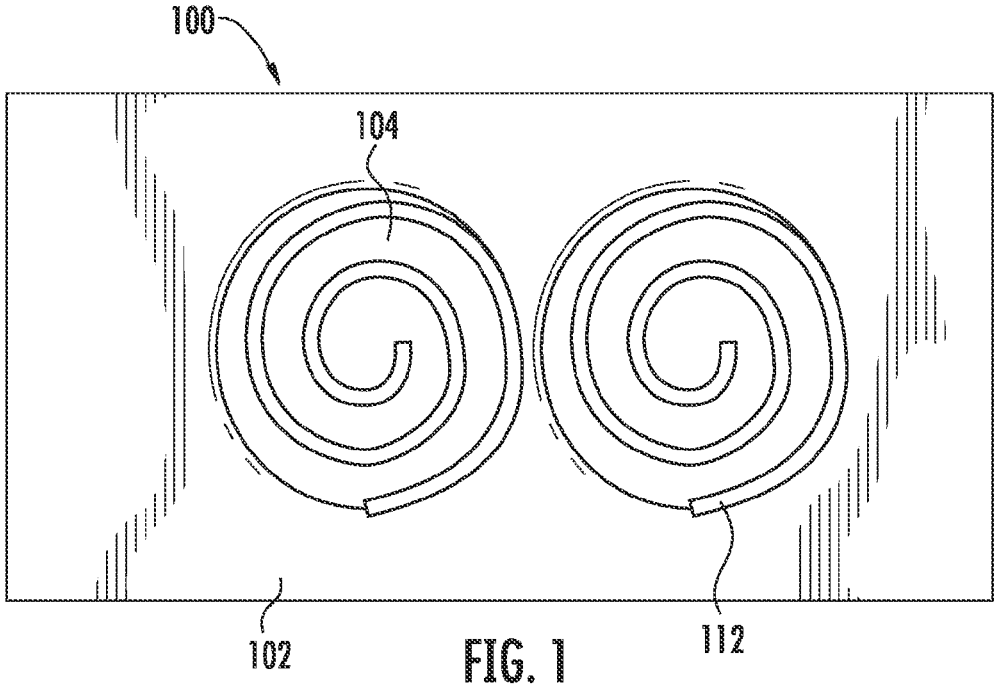
FIG. 1 is a plan view of an electrical contact according to one exemplary embodiment of the present disclosure.

The following description is merely exemplary in nature and is in no way intended to limit the present disclosure, application, or uses.

A number of exemplary embodiments of electrical contacts and methods are disclosed herein. The electrical contacts may be used, for example, to establish electrical contact between first and second electrically-conductive surfaces, such as a first electrically-conductive surface of a substrate (e.g., a ground trace of a PCB, etc.) and a second electrically conductive surface (e.g., a surface of an EMI shield, battery contact, housing, PCB, other mating surface, etc.). In an example embodiment, an electrical contact generally includes an electrically conductive base member and at least one resilient contact member. The at least one resilient contact member may have a configuration (e.g., generally spiral shape, multiple cantilevers, etc.) at least partially defined by a laser cut in or into the electrically conductive base member. Alternatively, the resilient contact member may be integrally formed by one or more other processes including, for example, other cutting processes, bending, drawing, stamping, molding, etc. The at least one resilient contact member may also be formed so as to protrude outwardly from the electrically conductive base member. The electrically conductive base member may be configured to be coupled (e.g., by soldering, welding, bonding, etc.) to an electrically conductive surface. The at least one resilient contact member may be configured to be operable for providing sufficient contact pressure to establish an electrical pathway between the first and second electrically conductive surfaces, when the electrically conductive base member is coupled (e.g., soldered, welded, bonded by electrically conductive epoxy, mechanically held in place with fasteners, etc.) to the first and/or second electrically conductive surfaces and the at least one resilient contact member is compressed between and in abutting contact with the first and second electrically conductive surfaces.

Other exemplary embodiments of electrical contacts are consistent with the present disclosure. In another example embodiment, an electrical contact may include an electrically conductive base member and at least one resilient contact member integrally formed with the electrically conductive base member. The at least one resilient contact member may define one or more shapes (e.g., generally spiral shape, single spiral, dual spiral, three or more spirals, cantilevers having generally arrowhead or stingray shapes, etc.). The resilient contact member may be integrally formed by one or more processes including, for example, cutting, laser cutting, bending, drawing, stamping, molding, etc. The at least one resilient contact member may be configured to be operable for providing sufficient contact pressure to establish an electrical pathway between the first and second electrically conductive surfaces, when the electrically conductive base member is coupled to the first and/or second electrically conductive surfaces and the at least one resilient contact member is compressed between and in abutting contact with the first and second electrically conductive surfaces.

It should be noted that various embodiments of the contacts disclosed herein may be used for different purposes. For example, exemplary uses of such electrical contacts are disclosed herein as establishing electrical contact from at least one electrically conductive surface on a substrate (e.g., PCB, etc.) to another electrically conductive surface (e.g., surface of an EMI shield or housing, etc.). In some embodiments, one or more electrical contacts disclosed herein may be used so as to provide a ground point only, whereby the contacts are not used with a high or steady enough electrical current to provide or accommodate data transmission unlike some "socket-style" connector assemblies having male and female connections specifically used for data transmission. Accordingly, the electrical contacts disclosed herein may also be generally referred to herein as grounding contacts even though the grounding contacts may also or alternatively be used for other suitable purposes. One such alternative use that is contemplated relates to the formation of an electrically pathway between two electrically conductive surfaces—one of which may be a battery contact or terminal.

Additional aspects are disclosed herein that relate to methods of making electrical contacts that may be used for establishing electrical pathways or conductivity (e.g., electrical grounding contact, etc.) from at least one electrically conductive surface (e.g., on a substrate, PCB, etc.) to another electrically conductive surface (e.g., EMI shield, battery terminal, battery contact, housing, etc.). Such a method of making an electrical contact may include, for example, cutting, laser cutting, bending, drawing, stamping, and/or molding, etc., one or more portion of an electrical contact. In an exemplary embodiment, a method of making an electrical contact generally includes laser cutting a portion of an electrically conductive base member so as to form at least a portion of least one resilient contact member. The method may also include forming or deforming the portion of the electrically conductive base member, such as before or after the laser cutting, such that the at least one resilient contact member protrudes outwardly from the electrically conductive base member.

Figure 2:
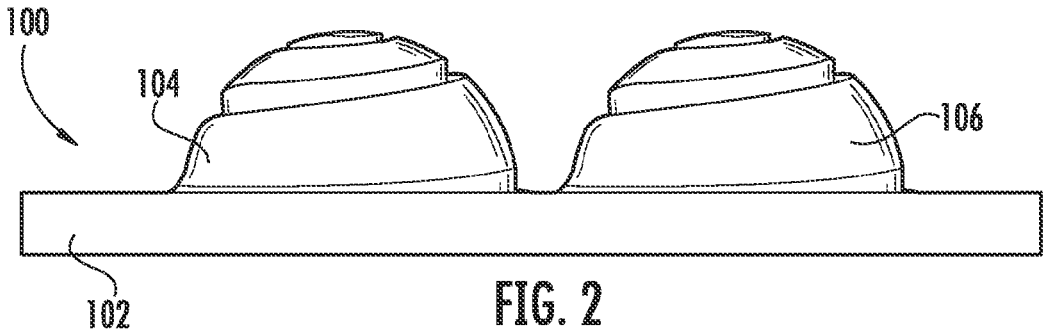
FIG. 2 is a front elevational view of the electrical contact shown in FIG. 1.
Figure 3:
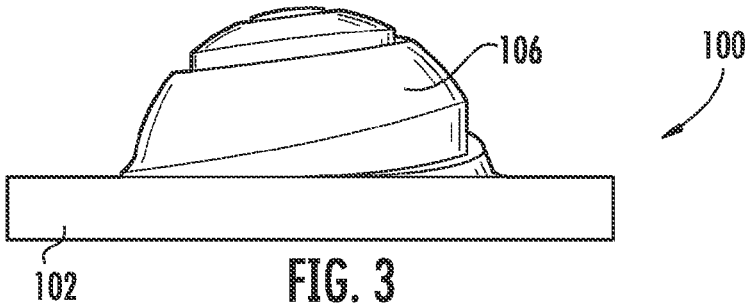
FIG. 3 is a side elevational view of the electrical contact shown in FIG. 1.

FIGS. 1 through 3 illustrate an example electrical contact 100 embodying one or more aspects of the present disclosure. As shown, the electrical contact 100 includes an electrically conductive base member 102 and first and second resilient contact members 104, 106. Each of the first and second resilient contact members 104, 106 have a configuration at least partially defined by a laser cut 112 in or into the electrically conductive base member 102. In this illustrated embodiment, the laser defined contact geometry for each of the first and second resilient contact members 104, 106 is a generally spiral shape. The generally spiral shape achieved by the spiral laser cut geometry 112 allows a relatively long cut to fit inside a fairly small space, where that extra length may help increase flexibility of the resilient contact members 104, 106. Alternative geometries (e.g., other single spirals, dual spirals, triple spirals, etc.) are also possible with the laser cutting or other cutting process as disclosed below. The selection/configuration of a particular laser defined contact geometry for a particular embodiment may depend or be based on laser cutting speed and laser path length that provides good efficiency. In other embodiments, the spiral geometry 112 of the first and second resilient contact members 104, 106 may be formed by one or more processes besides laser cutting, such as other cutting processes, bending, drawing, stamping, molding, etc.

In various embodiments, the laser cut may have a width of about 0.05 millimeters, such as when cutting with a fiber laser in which the active gain medium is an optical fiber doped with rare-earth elements such as erbium, ytterbium, neodymium, dysprosium, praseodymium, and thulium. Alternative embodiments may include cuts in different configurations, in widths different than 0.05 millimeters, and/or cuts made with other cutting devices besides a fiber laser, including other laser devices and non-laser cutting devices.

The first and second resilient contact members 104, 106 are also formed (e.g., before or after the laser cutting) so as to protrude outwardly from the electrically conductive base member 102, such that the resilient contact members 104, 106 are non-planar or not co-planar with the electrically conductive base member 102. In this particular embodiment shown in FIGS. 2 and 3, the resilient contact members 104, 106 comprise generally rounded (e.g., ogival, etc.) formed protrusions. Alternative configurations (e.g., shapes, etc.) are possible for the resilient contact members 104, 106. For example, some embodiments may include first and second resilient contact members where the first resilient contact member has a different configuration (e.g., shape, laser cut, etc.) than the second resilient contact member.

In use, the resilient contact members 104, 106 preferably provide sufficient contact pressure to establish an electrical pathway between first and second electrically conductive surfaces (e.g., 108, 110 in FIG. 4, etc.), when the electrically conductive base member 102 is coupled to (e.g., soldered, welded, bonded, etc.) the first and/or second electrically conductive surfaces and the resilient contact members 104, 106 are compressed, deformed, etc. between and/or in abutting contact with the first and second electrically conductive surfaces.

While the contact 100 includes two resilient contact members 104, 106, other exemplary embodiments may include more or less than two resilient contact members as the number of resilient contact members may vary or be different in other embodiments depending, for example, on the intended end use of the contact. In one example, an electrical contact may include one, three, four, fives, or a different suitable number of resilient contact members potentially depending on handling of an electrical contact, assembly of an electrical contact, PCB size limitations, one or more characteristics of an intended electrical pathway through an electrical contact, etc.

Figure 4:
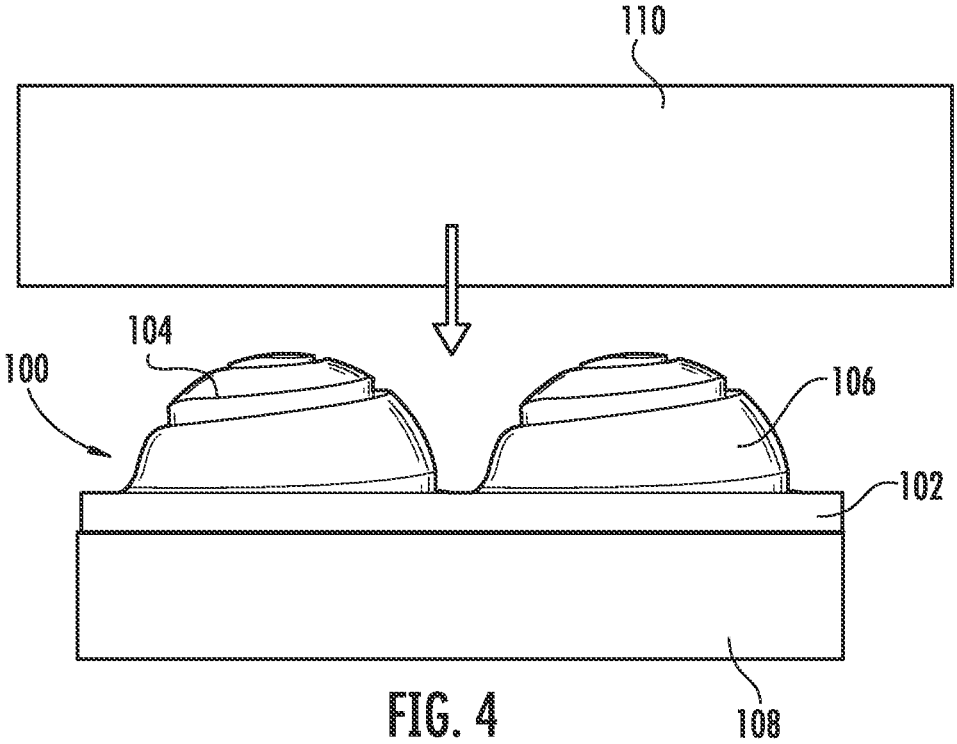
FIG. 4 is exploded elevational view of an assembly including the electrical contact of FIG. 1 disposed between a printed circuit board (PCB) and an electromagnetic interference (EMI) shield.

FIG. 4 illustrates the electrical contact 100 disposed generally between a PCB (or other substrate or surface) 108 and an EMI shield 110 (or other suitable component). In this position, the electrical contact 100 may provide an electrical pathway between the PCB 108 and the EMI shield 110 (after the EMI shield 110 and/or PCB 108 are moved relative to the contact 100 such that the contact 100 is compressively sandwiched between the PCB 108 and EMI shield 110). Accordingly, the electrical contact 100 may provide electrical ground contact between a ground trace of the PCB 108 and the EMI shield 110, even though the electrical contact 100 may also or alternatively be used for other suitable purposes. One such alternative use contemplated for the electrical contacts described herein may include forming an electrical pathway between various types of electrically conductive surfaces—one of which may be a battery terminal.

Continuing with the example shown in FIG. 4, the electrical contact 100 may be coupled to the PCB 108 (e.g., soldered, molded, adhered, conductive epoxied, welded, mechanically fastened, etc.) in a manner so as to make good electrical contact between an electrically conductive surface of the PCB 108 and the electrical contact 100. The PCB 108 and the EMI shield 110 may cooperatively generate sufficient compressive force to create sufficient contact pressure between the electrical contact 100 and the PCB 108 and/or the EMI shield 110 to establish good electrical conductivity therebetween. For example, the resilient contact members 104, 106 may be resiliently deflectable, deformable, compressible, etc. into a collapsed orientation between the PCB 108 and EMI shield 110 where that collapsed orientation is characterized by the first and second resilient contact members 104, 106 collapsing generally towards (which direction would be downwards in FIG. 4) the electrically conductive base member 102. This flexing or compression of the resilient contact members 104, 106 may occur, for example, when the electrical contact 100 is compressively sandwiched between the PCB 108 and the EMI shield 110 (indicated by an arrow in FIG. 4), such that there is applied to the resilient contact members 104, 106 a load or force with a downward component, generally orthogonal to a longitudinal axis of the electrical contact 100. When the EMI shield 110 is removed from the resilient contact members 104, 106, the resilient nature of the resilient contact members 104, 106 (e.g., resiliency of the material from which the contact 100 is made) may then permit the resilient contact members 104, 106 to return to an uncompressed configuration, position, and/or shape.

Each of the resilient contact members 104, 106 shown in FIG. 1 include or define a generally spiral shape. The spiral shape is achieved by the spiral laser cut geometry 112. Alternative configurations of contact members (e.g., shapes, profiles, resiliencies, etc.) may also formed in an electrically conductive base member in other embodiments, such as by laser cutting or by non-laser cutting processes, such as bending, drawing, stamping, molding, etc.

Figure 5:
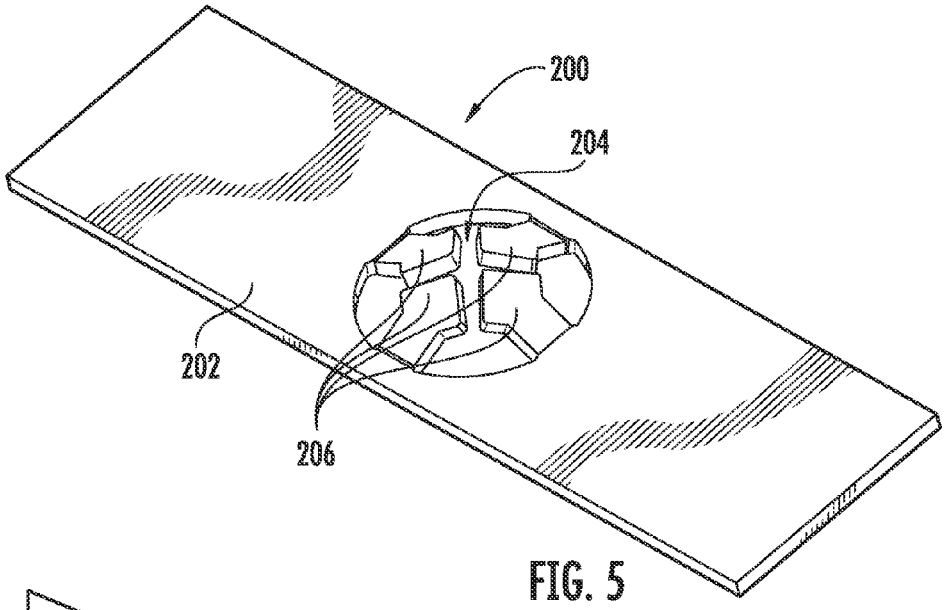
FIG. 5 is perspective view of an electrical contact according to another exemplary embodiment of the present disclosure.
Figure 6:
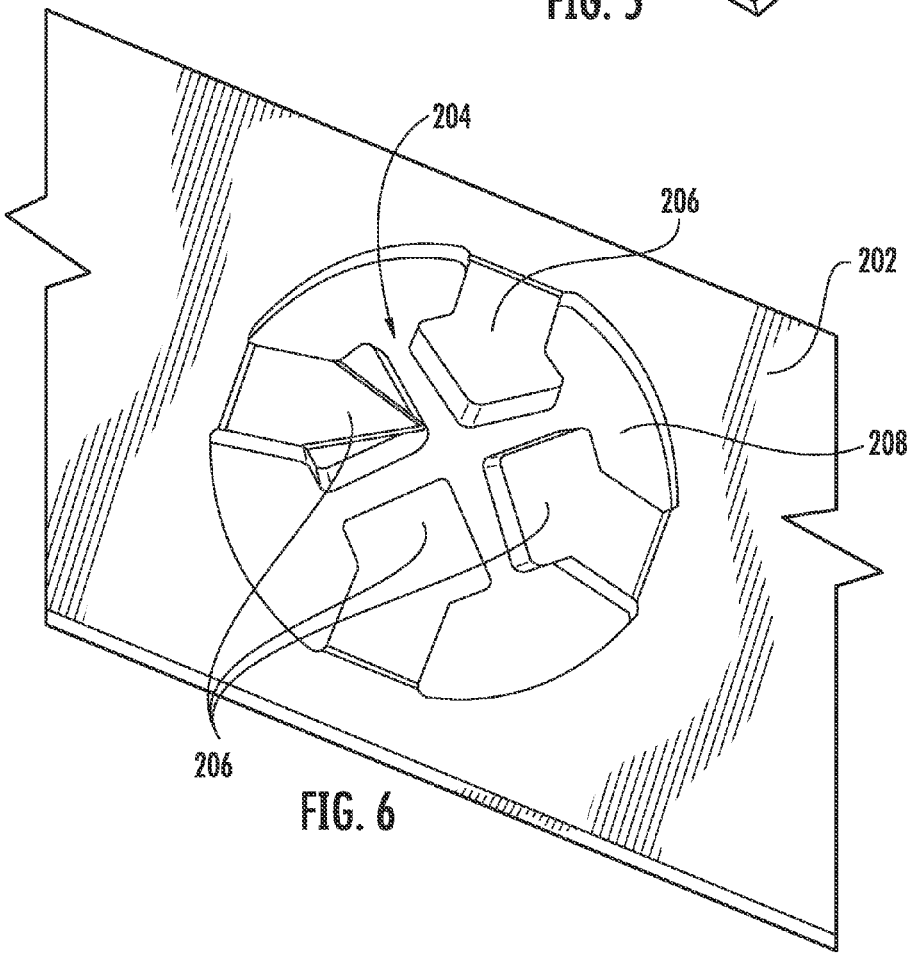
FIG. 6 is sectional view of the electrical contact shown in FIG. 5.
Figure 7:
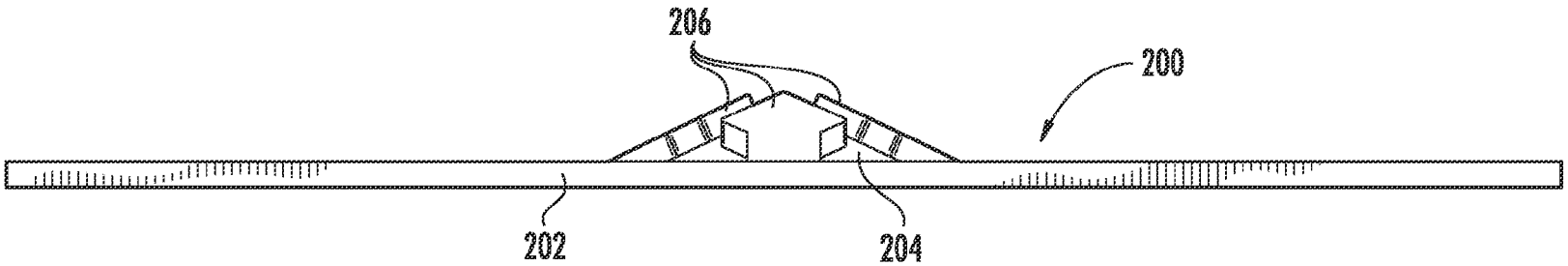
FIG. 7 is an elevational view of the electrical contact shown in FIG. 5.

For example, FIGS. 5 through 7 illustrate another exemplary embodiment of an electrical contact 200, which includes a resilient contact member 204 having multiple cantilevers 206. Each cantilever 206 is independently resilient and defines a generally stingray or arrowhead shape. In this particular embodiment, the resilient contact member 204 includes four cantilevers radially spaced apart or along the contact 200. The cantilevers 206 may be formed by laser cutting or by other processes, such as non-laser cutting, bending, drawings, stamping, molding, etc.

Also shown in FIGS. 5 through 7, each cantilever 206 includes a distal end portion extending away from the electrically conductive base member 202. The distal end portions extend towards the center of the contact member 204 such that the distal end portions of the cantilevers 206 are adjacent. While each of the distal ends extends toward a central point of the contact member 204 in the embodiment of FIGS. 5 through 7, different configurations (e.g., more or less than four cantilevers, differently shaped/sized/located cantilevers, etc.) of one or more cantilevers may be employed in other embodiments.

Alternative embodiments of electrical contacts may also include multiple resilient contact members with each resilient contact member having a different, similar, or identical configuration. In some embodiments, the particular shape of the contact member may be customized or tailored for a particular installation. The particular configuration of a contact member may depend, for example, on the space considerations and/or extent of the compression needed or desired in order to produce adequate contact pressure effective for establishing an electrical pathway between electrically conductive surfaces.

Referring again to FIGS. 1 through 3, each of the resilient contact members 104, 106 are defined in a bounded portion of the electrically conductive base member 102 such that each resilient contact member 104, 106 is bounded by the electrically conductive base member 102. In other embodiments, one or more contact members may incorporate a side and/or an edge of an electrically conductive base member such that the one or more resilient contact members are not bounded by the electrically conductive base member. In some embodiments, the particular position of the contact member within the electrical contact may be customized or tailored for a particular installation. The particular position may depend, for example, on the space considerations and/or extent of the compression needed or desired in order to produce adequate contact pressure effective for establishing an electrical pathway.

The particular dimensions of an electrical contact may vary depending on the particular embodiment and intended end use thereof. In an example embodiment, the resilient contact members 104 and 106 (FIGS. 1 through 3) may be spaced apart by a distance of about 1.0 millimeter. In other embodiments, multiple contact members may be spaced apart by a various suitable distances based on one or more characteristics of an electrical pathway, an electrically conductive surface, a particular material, etc.—for example, about five millimeters, about two millimeters, or another suitable distance, etc. In various embodiments, for example, spacing between the resilient contact members may be dependent on facilitating assembly or handling of an electrical contact.

Figure 8:
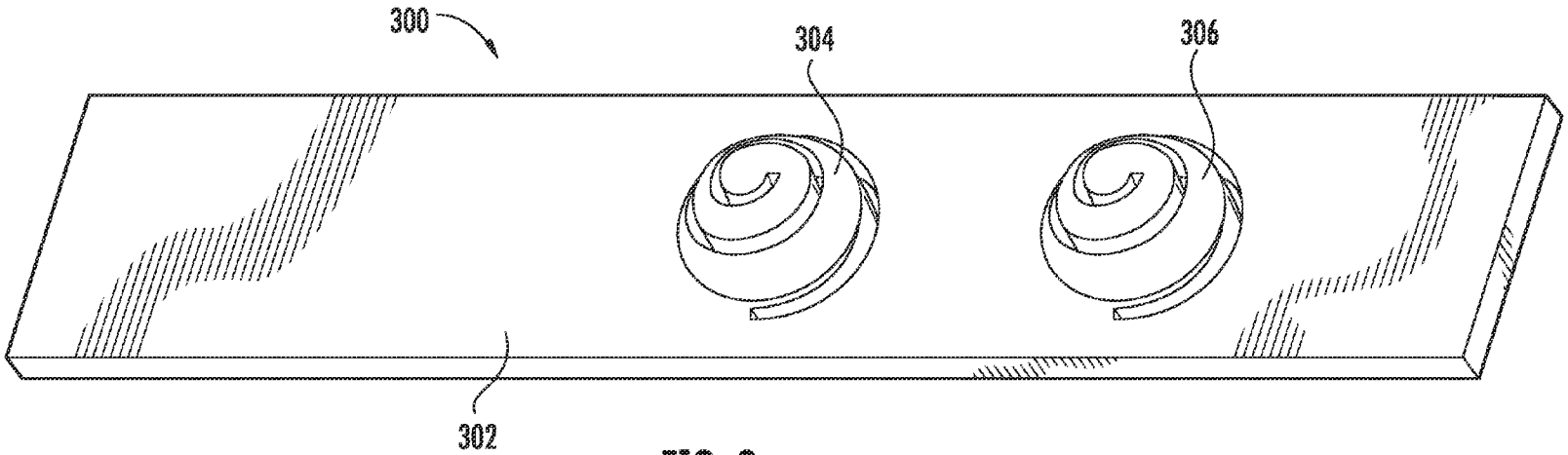
FIG. 8 is perspective view of an electrical contact according to an exemplary embodiment of the present disclosure.

For example, FIG. 8 illustrates an electrical contact 300 according to another example embodiment of the present disclosure. The electrical contact 300 includes an electrically conductive base member 302 and two resilient contact members 304, 306 laser cut into the electrically conductive base member 302. In this particular exemplary embodiment, the contact members 304, 306 are spaced apart by a distance of about 1.75 millimeters. This 1.75 millimeter spacing may permit vacuum pick up between the contact members 304, 306, thus making the contact 300 compatible with surface mount technology (SMT). In other embodiments, the resilient contact members (e.g., 104, 106, 304, 306) may be spaced apart more or less than 1.75 millimeters. For example, another exemplary embodiment includes resilient contact members spaced apart about 1 millimeter. In other embodiments, the resilient contact members 304, 306 may be formed by one or more processes besides laser cutting, such as other cutting processes, bending, drawing, stamping, molding, etc.

Accordingly, and depending on the particular sizing of a contact (e.g., 100, 200, 300, etc.), the contacts disclosed herein may thus be compatible with surface mount technology. This, in turn, should allow for relatively low cost installation to PCBs or other substrates using existing pick-and-place equipment, such as grippers, pneumatic heads, vacuum pick-and-place heads, suction cup pick-and-place heads, etc. Some of the contacts disclosed herein may be adapted to be installed utilizing conventional tape-and-reel SMT compatible systems. In such systems, an SMT machine's vacuum (or gripper) head may pick up and place a contact directly onto a ground location, such as a location on a ground trace of a PCB, which may have been previously screened with solder-paste. At an appropriate manufacturing step, the solder may be reflowed to bond the contact to the PCB ground trace. Therefore, at least some embodiments of the present disclosure may be installed without the need for specialized or customized installation equipment.

Additionally, the overall shape and size of the electrical contact may be dependent on one or more characteristics of an installation site, an electrical pathway, and/or a method of distribution, etc. In one example embodiment, an electrical contact includes dimensions of about 7 millimeters by about 1.5 millimeters, with a thickness of about 0.15 millimeters (not including the extension of the contact members)—as shown in FIG. 8. Different dimensions may be included in other electrical contacts to aid in distribution of the electrical contacts—for example, an electrical contact may include dimensions for a surface mount components distributed in a tape and reel. Other configuration of electrical contacts may be distributed in various other types of packaging, which may or may not affect one or more dimensions of an electrical contact.

In addition to spacing between the contact members, the height of a resilient contact member may generally depend on the particular forming process and/or the desired distance between first and second electrically conductive surfaces, e.g., a PCB, an EMI shield, a battery terminal, etc. In the embodiment of FIG. 8, each resilient contact member 304, 306 has a height of about 0.5 millimeters above the electrically conductive base member 302. One or more different heights of contact member may be employed in other electrical contact embodiments—for example, different heights of contact members included in the same electrical contact.

With further reference to FIGS. 1 through 3, the electrical contact 100 includes two resilient contact members 104, 106 protruding outwardly from the same side of the electrically conductive base member 102 in the same direction (which direction is up in FIG. 2). Alternatively, an electrical contact may include multiple contact members with at least one contact member extending from one side of an electrically conductive base member and at least one contact members extending from a different side of the electrically conductive base member and in the opposite direction. In this manner, resilient contact members may provide pressure to multiple electrically conductive surfaces abutting the different sides of the electrically conductive base member.

Each of the example embodiments of electrical contacts (e.g., electrical contact 100, 200, 300, etc.) disclosed herein may be made from various types of electrically conductive and/or non-conductive materials, including coated and uncoated metals (e.g., stainless steel, beryllium copper, copper alloys, cold rolled steel, etc.) and plastics coated with electrically conductive materials (e.g., copper, nickel, gold, silver, tin, etc.). In some embodiments, an electrically conductive base member may be formed from a solderable material. Additionally or alternatively, an electrically conductive base member may be formed from a sufficiently stiff or rigid material so as to impart sufficient stiffness to an electrical contact to permit manufacture according to the methods described herein and/or efficient handling of the electrical contact. A wide range of materials may be used for the electrically conductive base member, including coated and uncoated metals (e.g., stainless steel, beryllium copper, copper alloys, cold rolled steel, etc.) and plastics coated with electrically conductive materials (e.g., copper, nickel, gold, silver, tin, etc.). A contact member of an electrical contact according to the present disclosure may also be made from a variety of materials, including those listed above with respect to the electrically conductive base member or different materials than those listed above.

In some embodiments, when a contact member is integrally formed with an electrically conductive base member, the contact member may be formed from substantially the same material as the electrically conductive base member.

Moreover, one or more of the contacts (or portions thereof) disclosed herein may be plated with an electrically conductive material. Plating may encompass any portion of an electrical contact (e.g., 100, 200, 300, etc.), including the entire contact or only a portion thereof (e.g., 102, 104, 106, 202, 204, 302, 304, 306, etc.). In some embodiments, only that portion(s) (e.g., tip of resilient contact members 104, 106, 206, 304, 306, etc.) of an electrical contact that is intended to make direct physical contact with an electrically conductive surface may be selectively plated. Additionally or alternatively, an electrically conductive base member may be partially or wholly plated. Plating as described herein may include gold, silver, tin, or a different suitable material or combination of materials. For example, the plating may occur before or after the laser cutting and/or before or after the forming/deforming steps.

The electrical contact (e.g., 100, 200, 300, etc.) or portion thereof may also be partially or wholly heat treated to conform to a particular specification and/or intended use. For example, the heat treatment may occur before or after the laser cutting and/or before or after the forming/deforming steps.

A description will now be provided of exemplary processes by which a particular embodiment of an electrical contact (e.g., electrical contact 100, 200, 300, etc.) may be made. In one example embodiment, a process may include deforming a portion of an electrically conductive base member and laser cutting the portion of the electrically conductive base member to form a resilient contact member. The contact member generally provides sufficient contact pressure when abutting an electrically conductive surface to establish an electrical pathway.

Referring to FIGS. 1 through 3, cutting a portion of the electrically conductive base member 102 includes laser cutting a spiral geometry 112 into the electrically conductive base member 102, thereby defining a spiral shape. Referring to FIGS. 5 through 7, geometry 208 is laser cut into the electrically conductive base member 202 of contact 202 to define the multiple cantilevers 206. Each of the cantilevers 206 defines a generally stingray shape. Different geometries defining various other configurations of contact members may be laser cut into an electrically conductive base member in other embodiments depending, for example, on a configuration (e.g., type, shape, size, etc.) of an electrically conductive surface intended to be contacted by the contact member.

Moreover, another method of forming a contact member (e.g., cutting, drawing, bending, cutting, etc.) may be utilized in other embodiments. In one example, a method may include multiple cutting steps and/or multiple deforming steps to form one or more contact members.

Forming or deforming a portion of an electrically conductive base member may occur prior to or after laser cutting the portion of the electrically conductive base member. The order of the cutting and/or deforming may depend on the type of electrical contact and/or a configuration of one or more contact members. Additionally, deforming a portion of an electrically conductive base member base may occur between multiple cuttings steps, or cutting a portion of an electrically conductive base member may occur between multiple deforming steps. A number of deforming and/or cutting steps may be employed in other methods to form an electrical contact having one or more resilient contact members.

By making contacts at least partially by laser cutting, some embodiments may allow for contacts to be made with fewer overall processing/manufacturing steps, to be made with less material, to be made in smaller sizes (e.g., laser cut widths of 0.5 millimeters, etc.), and/or with lower costs to produce. In addition, the laser cutting and geometries provided thereby may also provide relatively flexible contacts that are sufficiently flexible to accommodate for dimensional variation of the surfaces be electrically connected by the contacts.

A description will now be provided of an exemplary process by which contacts may be installed onto a substrate using pick-and-place equipment (e.g., gripper, pneumatic head, vacuum pick-and-place head, suction cup pick-and-place head, etc.). In this example, the contacts (e.g., 100, 200, 300, etc.) may be stored in pockets of a continuous tape reel for retrieval by a head (not illustrated) of a pick-and-place machine, such as a gripper, pneumatic head, vacuum pick-and-place head, suction cup pick-and-place head, etc. The contacts may be positioned in the upwardly opening pockets of a plastic carrier tape. A cover strip may be adhesively applied to the top layer of the carrier tape to hold the contacts in position within the pockets. The carrier tape may be wound onto or wrapped around a reel before shipment to a customer. Upon receipt, the customer may install the reel (with the contacts in the pockets thereof) on a feeder of an automatic pick-and-place machine. The carrier tape may have holes formed along one or both side edges thereof for driving through a feeder mechanism installed in a pick-and-place machine. The tape, with the contacts stored within the pockets, and the cover layer in place, may be unwound from the supply reel in the feeder. The feeder peels back the top cover layer and the head (not illustrated) of the pick-and-place machine may use a gripper to pick-up a contact from its corresponding pocket in the tape. After retrieving the contact from the pocket, the head may then position the contact onto a PCB ground trace, which may have been pre-screened with solder-paste. The PCB and the contacts sitting atop the PCB ground traces may then be sent through a solder reflow oven (such as infrared (IR), vapor-phase, convection, etc.) to melt the solder joints and form an electrical and mechanical connection therebetween. By providing contacts capable of being retrieved from pockets and then placed onto PCBs by pick-and-place machines associated with assembly line production, embodiments disclosed herein may allow for increased productivity for assembly line production of printed circuit boards, etc.

An installer may still choose to install the contacts by hand or by using other mechanical means besides SMT equipment. Plus, alternative embodiments may include contacts that are not compatible with SMT technology.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms (e.g., different materials may be used, etc.) and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping or distinct) subsume all possible combination of ranges for the value that might be claimed using endpoints of the disclosed ranges.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An electrical contact for establishing an electrical pathway between first and second electrically conductive surfaces, the electrical contact comprising:

an electrically conductive base member for coupling to a first electrically-conductive surface of a substrate, the electrically conductive base member comprising metal; and at least one resilient contact member having a configuration at least partially defined by a laser cut into the metal of the electrically conductive base member and being integrally formed from the electrically conductive base member so as to protrude outwardly from the electrically conductive base member.

2. The electrical contact of claim 1, wherein the at least one resilient contact member includes multiple resilient contact members each of which includes a metal protrusion integrally formed from the electrically conductive base member so as to protrude outwardly from the electrically conductive base member, the metal protrusion being laser cut to thereby provide a laser-cut defined contact geometry.

3. The electrical contact of claim 1, wherein:

the at least one resilient contact member includes a rounded ogival metal protrusion protruding outwardly from the electrically conductive base member; and the configuration of the at least one resilient contact member includes a generally spiral shape laser cut into the rounded ogival metal protrusion.

4. The electrical contact of claim 1, wherein the configuration of the at least one resilient contact member includes at least one of:

a generally arrowhead shape; or a stingray shape.

5. The electrical contact of claim 1, wherein the at least one resilient contact member includes multiple cantilevers, each cantilever being independently resilient and including a free distal end portion extending away from the electrically conductive base member, wherein the free distal end portions of the cantilevers extend towards a center of the at least one resilient contact member such that the free distal end portions of the cantilevers are adjacent.

6. The electrical contact of claim 5, wherein at least one of said cantilevers includes a generally arrowhead or stingray shape.

7. The electrical contact of claim 1, wherein the at least one resilient contact member includes first and second resilient contact members spaced apart from each other by a distance of at least 1 millimeter that is sufficient to allow vacuum pick up therebetween.

8. The electrical contact of claim 7, wherein:

the first and second resilient contact members protrude outwardly from opposite sides of the electrically conductive base members in opposite directions; or the first and second resilient contact members protrude outwardly in the same direction from the same side of the electrically conductive base member.

9. The electrical contact of claim 1, wherein:

the at least one resilient contact member is bounded on each side by the electrically conductive base member; and at least a portion of the at least one resilient contact member is non-planar with the electrically conductive base member; and at least a portion of the electrical contact is plated with an electrically conductive material.

10. The electrical contact of claim 1, wherein the electrical contact is compatible with surface mount technology.

11. The electrical contact of claim 1, wherein:

the laser cut has a width of 0.05 millimeters; and/or the at least one resilient contact member has an uncompressed height of between about 0.2 millimeters to about 2.0 millimeters.

12. The electrical contact of claim 1, wherein:

the at least one resilient contact member is deflectable or deformable into a collapsed orientation between the first and second electrically conductive surfaces characterized in that the at least one resilient contact member collapses generally towards the electrically conductive base member; and the at least one resilient contact member is operable for providing sufficient contact pressure to establish an electrical pathway between the first and second electrically conductive surfaces, when the electrically conductive base member is coupled to the first and/or second electrically conductive surfaces and the at least one resilient contact member is compressed between and in abutting contact with the first and second electrically conductive surfaces.

13. The electrical contact of claim 1, wherein the at least one resilient contact member is integrally formed from the electrically conductive base member, so as to have multiple cantilevers or a generally ogival and spiral shape, the at least one resilient contact member protruding outwardly from the electrically conductive base member.

14. The electrical contact of claim 1, wherein:

the at least one resilient contact member includes a generally ogival metal protrusion protruding outwardly from the electrically conductive base member; and the at least one resilient contact member has a generally spiral shape defined by a laser cut into the generally ogival metal protrusion that is protruding outwardly from the electrically conductive base member.

15. The electrical contact of claim 1, wherein the at least one resilient contact member includes multiple cantilevers defined by a laser cut into the metal of the electrically conductive base member.

16. The electrical contact of claim 15, wherein:

at least one of the multiple cantilevers defines a generally stingray or arrowhead shape; and/or each of the multiple cantilevers is independently resilient; and/or a distal end portion of one of the multiple cantilevers is adjacent to a distal end portion of a different one of the multiple cantilevers.

17. The electrical contact of claim 13, wherein the at least one resilient contact member is operable for providing sufficient contact pressure to establish an electrical pathway between the first and second electrically conductive surfaces, when the electrically conductive base member is coupled to the first and/or second electrically conductive surfaces and the at least one resilient contact member is compressed between and in abutting contact with the first and second electrically conductive surfaces.

18. A method of making an electrical contact of claim 1 that is capable of establishing an electrical pathway between first and second electrically conductive surfaces, the method comprising laser cutting a metal portion of the electrically conductive base member so as to form at least a portion of the at least one resilient contact member.

19. The method of claim 18, further comprising forming or deforming the metal portion of the electrically conductive base member so that the metal portion protrudes outwardly from the electrically conductive member, and wherein forming or deforming the metal portion of the electrically conductive base member occurs prior to laser cutting.

20. The method of claim 19, wherein:

forming or deforming the metal portion of the electrically conductive base member includes drawing the metal portion of the electrically conductive base member; and laser cutting the metal portion of the electrically conductive base member includes laser cutting a spiral geometry into the drawn metal portion of the electrically conductive base member.

21. The method of claim 18, wherein laser cutting the metal portion of the electrically conductive base member includes laser cutting multiple cantilevers into the metal portion of the electrically conductive base member, each of the multiple cantilevers being independently resilient.

22. The method of claim 18, wherein:

the at least one resilient contact member includes first and second resilient contact members, such that the method includes laser cutting corresponding first and second metal portions of the electrically conductive base member; and the method further comprises:

plating at least a portion of the at least one resilient contact member and/or the electrically conductive base member; and heat treating at least a portion of the at least one resilient contact member and/or the electrically conductive base member.

* * * * *